US008259015B2

(12) United States Patent
Wu et al.

(10) Patent No.: US 8,259,015 B2
(45) Date of Patent: Sep. 4, 2012

(54) ANTENNA MODULE

(75) Inventors: Chao-Hsu Wu, Luzhu Township, Taoyuan County (TW); Cheng-Hsiung Wu, Kaohsiung (TW)

(73) Assignee: Quanta Computer Inc., Tao Yuan Shien (TW)

( * ) Notice: Subject to any disclaimer, the term of this patent is extended or adjusted under 35 U.S.C. 154(b) by 387 days.

(21) Appl. No.: 12/759,758

(22) Filed: Apr. 14, 2010

(65) Prior Publication Data

US 2011/0175775 A1 Jul. 21, 2011

(30) Foreign Application Priority Data

Jan. 18, 2010 (TW) ..... 99101200 A

(51) Int. Cl.
*H01Q 1/24* (2006.01)

(52) U.S. Cl. ..... 343/702; 343/700 MS

(58) Field of Classification Search ..... 343/700 MS, 343/702

See application file for complete search history.

(56) References Cited

U.S. PATENT DOCUMENTS

| | | | | |
|---|---|---|---|---|
| 3,035,168 | A * | 5/1962 | Housman | 455/152.1 |
| 6,049,314 | A * | 4/2000 | Munson et al. | 343/846 |
| 6,342,868 | B1 * | 1/2002 | Tsai et al. | 343/795 |
| 6,529,172 | B2 * | 3/2003 | Zimmerman | 343/797 |
| 2007/0285321 | A1 * | 12/2007 | Chung et al. | 343/702 |

* cited by examiner

*Primary Examiner* — Tho G Phan
(74) *Attorney, Agent, or Firm* — Hammer & Associates, P.C.

(57) ABSTRACT

An antenna module includes first, second, and third conductor arms. The second conductor arm has first and second end portions, and is coupled to an end portion of the first conductor arm to form a substantially T-shaped connection. The third conductor arm is spaced apart from the first and second conductor arms by first and second gaps, respectively, and is disposed parallel to the first conductor arm. The first end portion of the second conductor arm and the third conductor arm are electrically coupled to a coaxial cable for receiving two signals therefrom, respectively. The second end portion of the second conductor arm is electrically coupled to a ground cable for grounding.

7 Claims, 7 Drawing Sheets

Peak = -2.3 dBi, Avg. = -5.7 dBi.

Peak = -2.3 dBi, Avg. = -5.3 dBi.

Peak = -1.6 dBi, Avg. = -4.3 dBi.

ANTENNA MODULE

CROSS-REFERENCE TO RELATED APPLICATION

This application claims priority of Taiwanese Application No. 099101200, filed on Jan. 18, 2010.

BACKGROUND OF THE INVENTION

1. Field of the Invention

The present invention relates to an antenna module, more particularly to a planar antenna module operable in the UHF frequency band.

2. Description of the Related Art

Nowadays, wireless applications are ubiquitous, and mobility has become an important consideration during the design phase of various wireless electronic devices. To enhance mobility, dimensions of the wireless electronic devices, and hence antenna dimensions, need to be reduced. Conventional antenna modules having three-dimensional structures have become less suitable for deployment in wireless handheld electronic devices, and have been replaced by planar antenna modules.

SUMMARY OF THE INVENTION

Therefore, an object of the present invention is to provide an antenna module adapted to be coupled electrically to a coaxial cable for receiving first and second signals therefrom, and adapted to be coupled electrically to a ground cable for grounding, the antenna module comprising:

a first conductor arm having an end portion;

a second conductor arm having first and second end portions, and coupled to the end portion of the first conductor arm to form a substantially T-shaped connection; and a third conductor arm spaced apart from the first and second conductor arms by first and second gaps, respectively, and disposed parallel to the first conductor arm.

The first end portion of the second conductor arm is adapted for coupling electrically to the coaxial cable for receiving the second signal therefrom, the third conductor arm is adapted for coupling electrically to the coaxial cable for receiving the first signal therefrom, and the second end portion of the second conductor arm is adapted for coupling electrically to the ground cable for grounding.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
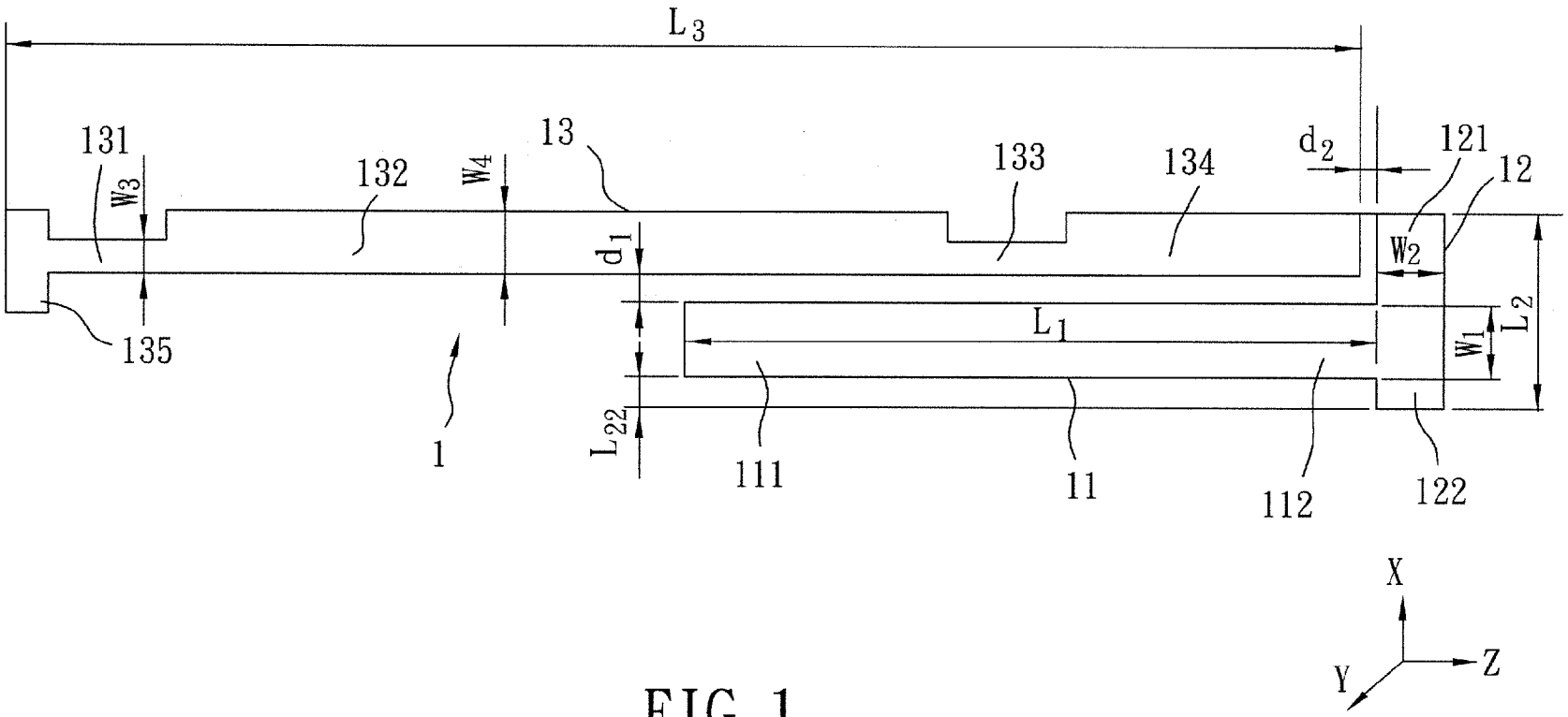
FIG. 1 is a schematic diagram of the preferred embodiment of an antenna module according to the present invention.

Referring to FIG. 1, the preferred embodiment of an antenna module 1 according to the present invention is adapted to be disposed on a circuit board (not shown), and includes a first conductor arm 11 having a first width $W_1$ and a first length $L_1$, a second conductor arm 12 having a second width $W_2$ and a second length $L_2$, and a third conductor arm 13 having a third length $L_3$. Each of the first and second conductor arms 11, 12 has a first end portion 111,121 and a second end portion 112, 122.

The second end portion 112 of the first conductor arm 11 and the second conductor arm 12 are electrically coupled to each other to form a substantially T-shaped connection. The third conductor arm 13 is disposed parallel to the first conductor arm 11, and is spaced apart from the first and second conductor arms 11, 12 by first and second gaps $d_1$ and $d_2$, respectively.

The third conductor arm 13 has a first portion 131, a second portion 132, a third portion 133, a feed-in portion 134, and a protrusion portion 135. The first portion 131 and the protrusion portion 135 are electrically coupled to each other to form a substantially T-shaped connection. One end of the first portion 131 opposite to the protrusion portion 135 is electrically coupled to the second portion 132. One end of the second portion 132 opposite to the first portion 131 is electrically coupled to the third portion 133. One end of the third portion 133 opposite to the second portion 132 is electrically coupled to the feed-in portion 134. The first and third portions 131, 133 have a third width $W_3$, and the second and feed-in portions 132, 134 have a fourth width W4.

The feed-in portion 134 and the first end portion 121 of the second conductor arm 12 are for coupling electrically to a coaxial cable (not shown) for receiving first and second signals (i.e., a positive signal and a negative signal) therefrom, respectively. The arrangement of the feed-in portion 134 and the first end portion 121 of the second conductor arm 12 with respect to the coaxial cable permits the antenna module 1 to radiate a signal, corresponding to the signals received from the coaxial cable, in the form of electromagnetic waves. Furthermore, the second end portion 122 of the second conductor arm 12 is for coupling electrically to a ground cable (not shown) for grounding.

The antenna module 1 of the present embodiment is operable in first and second operating frequency bands. The first operating frequency band (i.e., a lower operating frequency band) can be adjusted through adjusting the third length $L_3$ of the third conductor arm 13. The second operating frequency band (i.e., a higher operating frequency band) can be adjusted through adjusting the widths of the first and second gaps $d_1$, $d_2$ and a protruding length $L_{22}$ of the second end portion 122 of the second conductor arm 12 relative to the first conductor arm 11.

In the present embodiment, the optimum dimensions of the antenna module 1 are as follows:

the first, second, and third lengths $L_1$, $L_2$, $L_3$ being 50 mm, 13 mm, and 98 mm, respectively;

the first, second, third, and fourth widths $W_1$, $W_2$, $W_3$, $W_4$ being 5 mm, 5 mm, 2.5 mm, and 4.5 mm, respectively;

the widths of the first and second gaps $d_1$, $d_2$ being 2 mm and 1 mm, respectively;

the protruding length $L_{22}$ being 2 mm; and the thickness of the antenna module 1 being 0.6 mm.

Accordingly, the antenna module 1 of the present embodiment has the dimensions of 104 mm×13 mm×0.6 mm (L×W×H).

Figure 2:
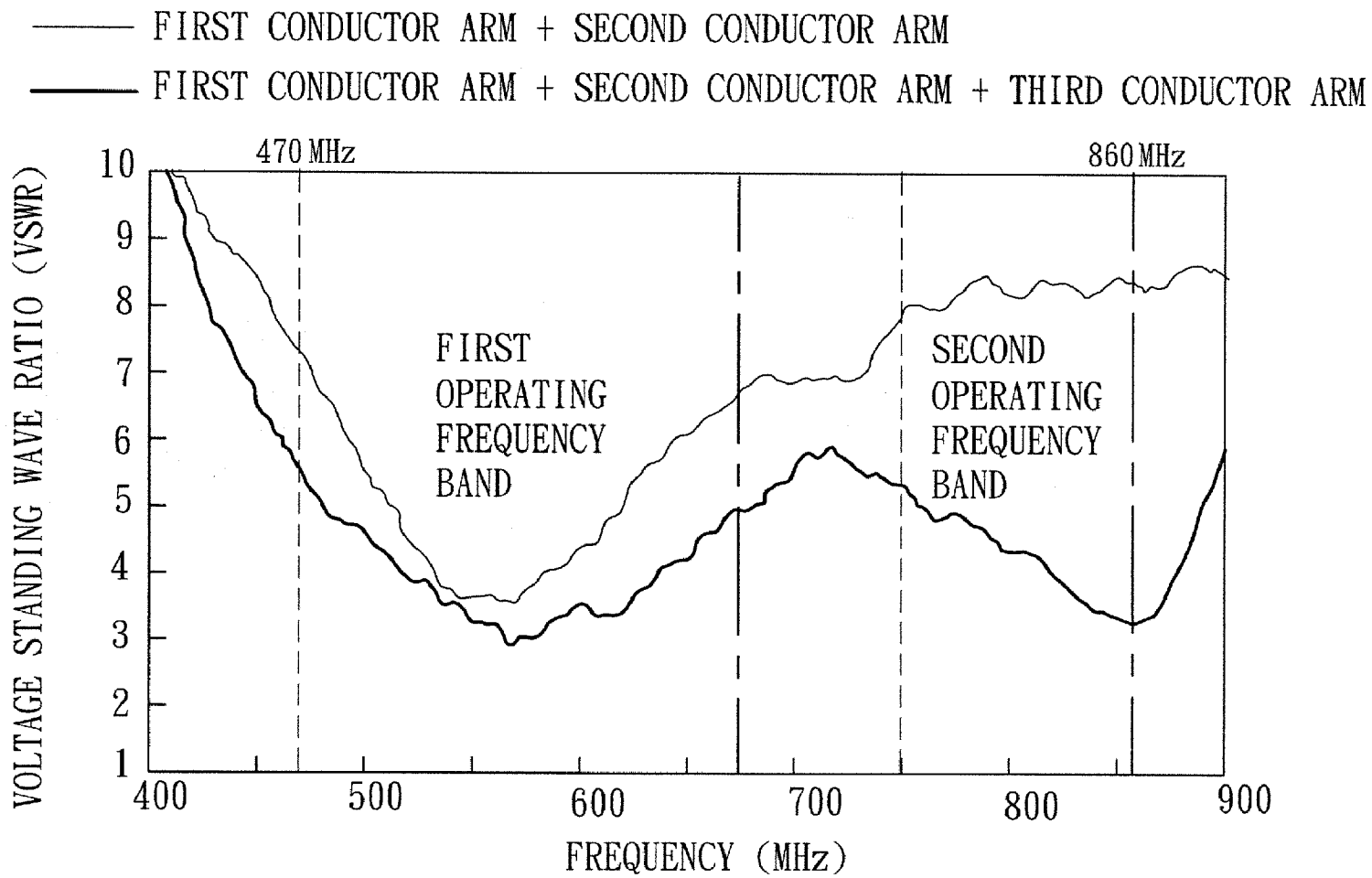
FIG. 2 is a Voltage Standing Wave Ratio (VSWR) plot showing VSWR values of the antenna module of the preferred embodiment and a comparative example that does not include a third conductor arm at frequencies ranging from 400 MHz to 900 MHz.

FIG. 2 shows the measured Voltage Standing Wave Ratio (VSWR) values of the antenna module 1 of the present embodiment and a comparative example that does not include the third conductor arm 13 at frequencies in the UHF frequency band, which ranges from 470 MHz to 860 MHz. In the present embodiment, the first and second operating frequency bands range from 470 MHz to 750 MHz and from 670 MHz to 860 MHz, respectively. Comparing the VSWR values of the antenna module 1 of the present embodiment and the comparative example, it is apparent that inclusion of the third conductor arm 13 in the antenna module 1 of the present embodiment permits operation in the second operating frequency band, and that the third length $L_3$ of the third conductor arm 13 can be adjusted to further lower the VSWR values of the antenna module 1 of the present embodiment in the first operating frequency band.

Figure 3:
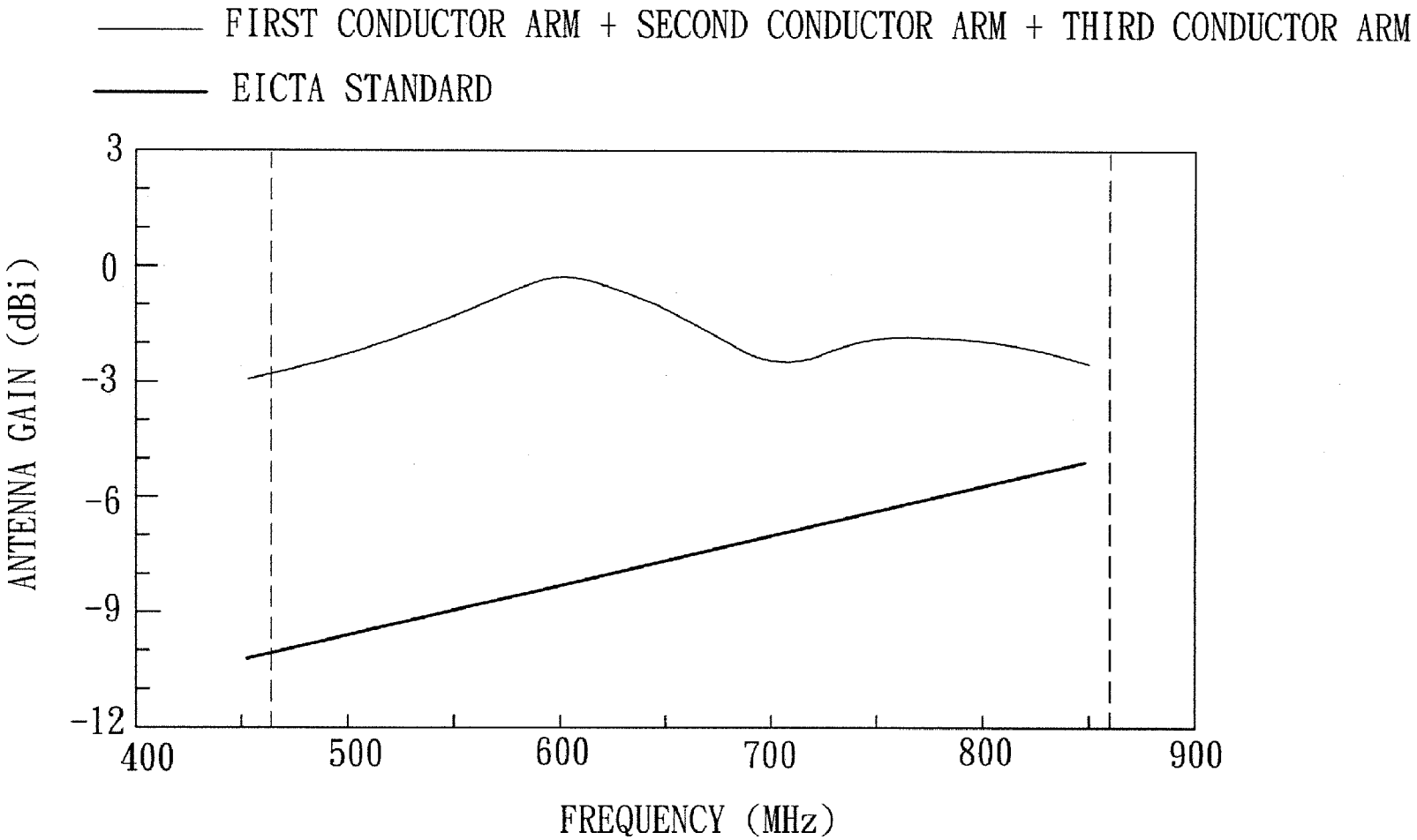
FIG. 3 is a gain plot showing gain values of the antenna module of the preferred embodiment and EICTA standard values at frequencies ranging from 470 MHz to 860 MHz.

FIG. 3 shows the measured gain values of the antenna module 1 of the present embodiment at frequencies in the UHF frequency band. It is apparent that the antenna module 1 of the present embodiment has gain values that comply with the Digital Video Broadcast-Handheld (DVB-H) standard specified by the European Information Communications Technology Association (EICTA)

Figure 5:
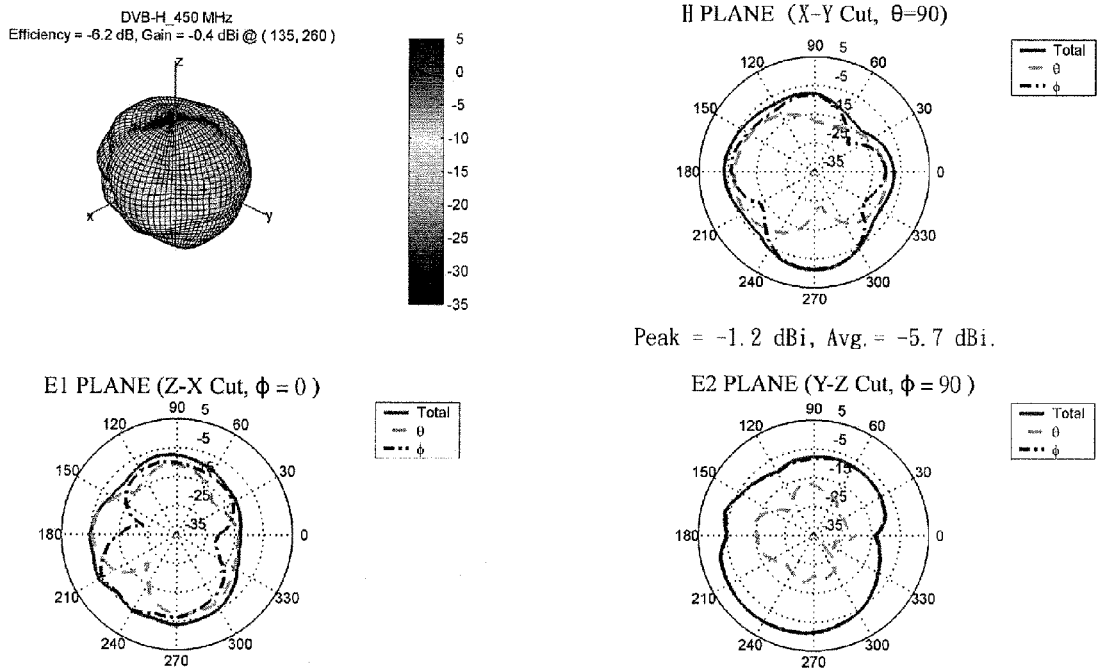
FIGS. 5 to 7 show radiation patterns of the antenna module of the preferred embodiment at frequencies of 450 MHz, 650 MHz, and 850 MHz, respectively.
Figure 6:
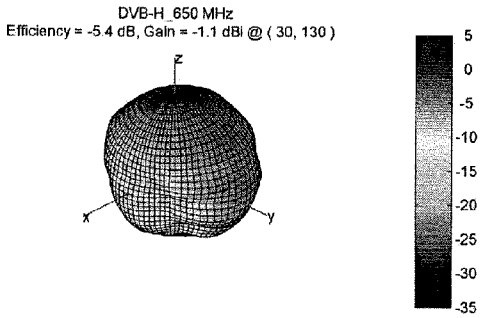
Figure 6:
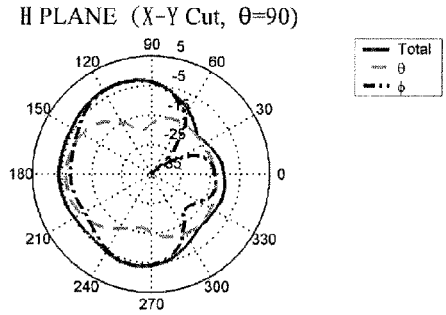
Figure 6:
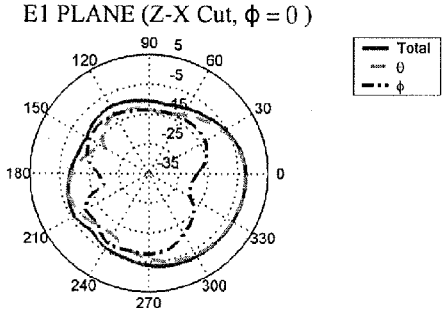
Figure 6:
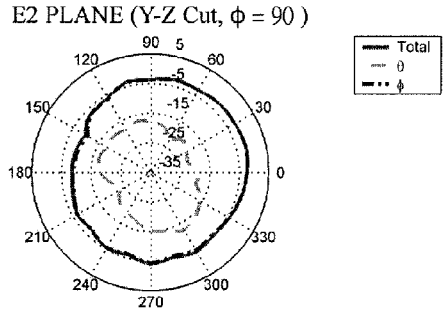
Figure 7:
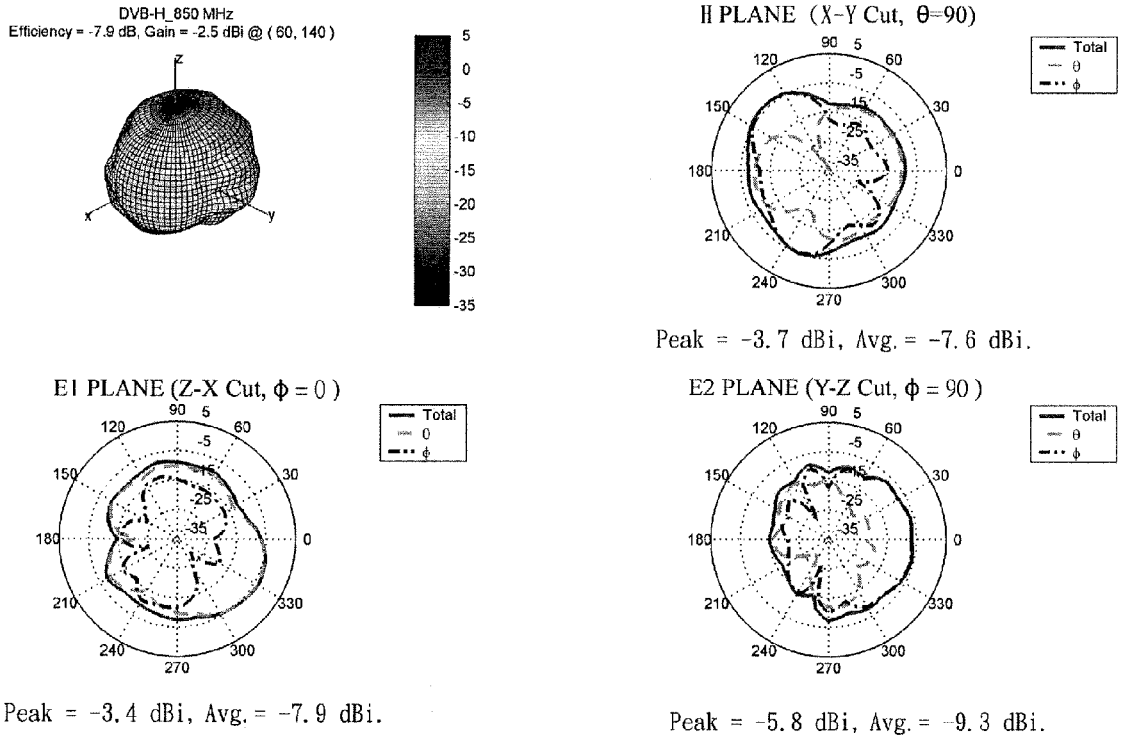

FIGS. 5, 6, and 7 show the measured radiation patterns of the antenna module 1 of the present embodiment at frequencies of 450 MHz, 650 MHz, and 850 MHz, respectively. It is to be noted that the x-y-z axes in FIGS. 5, 6, and 7 correspond to those in FIG. 1. As shown in FIGS. 5,6, and 7, the radiation patterns of the antenna module 1 at frequencies of 450 MHz, 650 MHz, and 850 MHz are substantially omni-directional.

Figure 4:
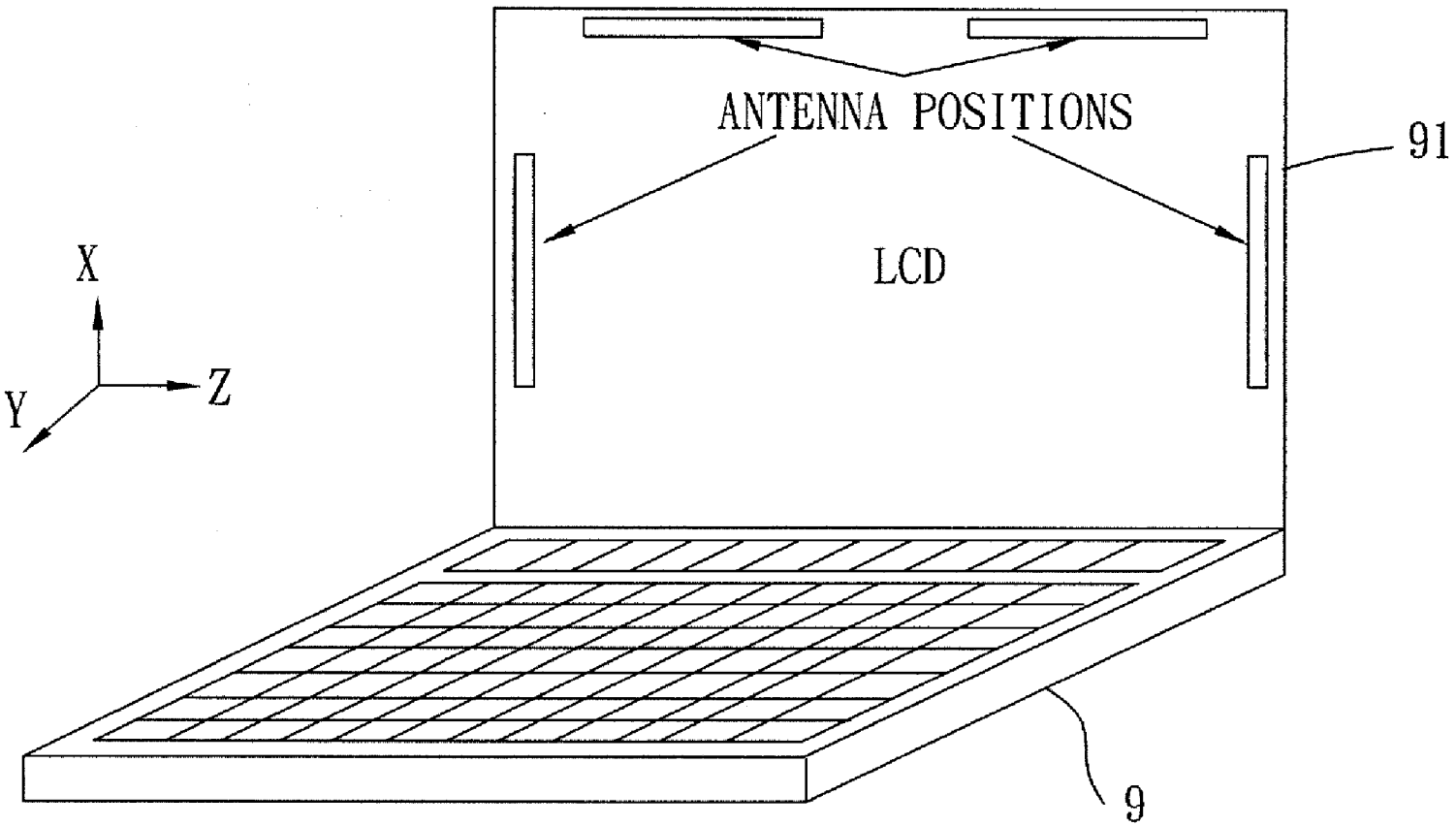
FIG. 4 is a schematic view of a notebook computer installed with four antenna modules of the preferred embodiment.

It is to be noted that more than one antenna module 1 may be employed in actual applications. For example, referring to FIGS. 1 and 4, a plurality of antenna modules 1 are installed along the frame of a Liquid Crystal Display (LCD) screen 91 of a notebook computer 9. The second end portion 122 of the second conductor arm 12 of each of the antenna modules 1 is coupled electrically to a ground cable (not shown) in the LCD screen 91. Moreover, the feed-in portion 134 of the third conductor arm 13 and the first end portion 121 of the second conductor arm 12 of each of the antenna modules 1 are coupled electrically to a coaxial cable in the notebook computer 9 for receiving signals therefrom and for radiating the signals in the form of electromagnetic waves.

In summary, the antenna module 1 of the present invention is suitable for transmitting and receiving electromagnetic signals at frequencies in the UHF frequency band, complies with the EICTA standard in terms of antenna gain, and have substantially omni-directional radiation patterns at frequencies of 450 MHz, 650 MHz, and 850 MHz. The third conductor arm 13 is resonant in the second operating frequency band, and the third length $L_3$ of the third conductor arm 13 can be adjusted to lower the VSWR values of the antenna module 1 in the first operating frequency band. Moreover, the planar configuration of the antenna module 1 results in lower fabrication costs and facilitates installation in electronic devices.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. An antenna module adapted to be coupled electrically to a coaxial cable for receiving first and second signals therefrom, and adapted to be coupled electrically to a ground cable for grounding, said antenna module comprising:

a first conductor arm having an end portion;

a second conductor arm having first and second end portions, and coupled to said end portion of said first conductor arm to form a substantially T-shaped connection; and a third conductor arm spaced apart from said first and second conductor arms by first and second gaps, respectively, and disposed parallel to said first conductor arm;

wherein said first end portion of said second conductor arm is adapted for coupling electrically to the coaxial cable for receiving the second signal therefrom, said third conductor arm is adapted for coupling electrically to the coaxial cable for receiving the first signal therefrom, and said second end portion of said second conductor arm is adapted for coupling electrically to the ground cable for grounding.

2. The antenna module as claimed in claim 1, wherein said third conductor arm has a feed-in portion having a width that is different from those of said first and second conductor arms, said feed-in portion being adapted for coupling electrically to the coaxial cable for receiving the first signal therefrom.

3. The antenna module as claimed in claim 2, wherein said third conductor arm further has first and third portions having a respective width that is different from that of said feed-in portion of said third conductor arm, and a second portion between said first and third portions and having a width that is the same as that of said feed-in portion.

4. The antenna module as claimed in claim 3, wherein said third conductor arm further has a protrusion portion coupled to said first portion of said third conductor arm to form a substantially T-shaped connection.

5. The antenna module as claimed in claim 1, wherein said first and second gaps have different widths.

6. The antenna module as claimed in claim 1, wherein said third conductor arm has a length that defines an operating frequency band of said antenna module.

7. The antenna module as claimed in claim 6, wherein dimensions of said first and second gaps and a protruding length of said second conductor arm relative to said first conductor arm cooperate to define another operating frequency band of said antenna module.

* * * * *